US007082946B2

(12) United States Patent
Farin et al.

(10) Patent No.: US 7,082,946 B2
(45) Date of Patent: Aug. 1, 2006

(54) METHOD AND APPARATUS FOR PROTECTING THE PASSENGERS OF AN AIRPLANE AGAINST HYPOXIA

(75) Inventors: Eric Farin, Fontenay sous Bois (FR); Michel Bardel, Maurepas (FR); Nicolas Bloch, Fontenay aux Roses (FR)

(73) Assignee: Intertechnique (FR)

( * ) Notice: Subject to any disclaimer, the term of this patent is extended or adjusted under 35 U.S.C. 154(b) by 0 days.

(21) Appl. No.: 10/284,714

(22) Filed: Oct. 31, 2002

(65) Prior Publication Data

US 2003/0101997 A1 Jun. 5, 2003

(30) Foreign Application Priority Data

Nov. 28, 2001 (FR) ..... 01 15371

(51) Int. Cl.
*A62B 18/02* (2006.01)

(52) U.S. Cl. ..... 128/205.25; 128/205.17; 128/205.24; 128/205.13

(58) Field of Classification Search ..... 128/205.25, 128/205.17, 205.24, 205.13
See application file for complete search history.

(56) References Cited

U.S. PATENT DOCUMENTS

| | | | | |
|---|---|---|---|---|
| 2,248,349 A | | 7/1941 | Heidbrink | |
| 2,558,975 A | | 7/1951 | Moreno | |
| 4,098,271 A | * | 7/1978 | Maddock | 128/202.22 |
| 4,766,893 A | * | 8/1988 | Drews | 128/201.29 |
| 4,821,712 A | | 4/1989 | Gossett | |
| 4,989,691 A | | 2/1991 | Wilkerson et al. | |
| 5,265,597 A | * | 11/1993 | Wallis | 128/205.25 |
| 5,343,859 A | * | 9/1994 | Kikut | 128/205.13 |
| 5,357,949 A | | 10/1994 | Bertheau et al. | |
| 5,408,995 A | * | 4/1995 | Contino et al. | 128/205.25 |
| 5,832,864 A | | 11/1998 | Hemphill | |

FOREIGN PATENT DOCUMENTS

DE 435916 10/1926

(Continued)

OTHER PUBLICATIONS

FR 2,557,463: Breathing Mask For Protection In Rarefied Atmosphere, Particularly For Passengers Of Airplanes Flying At High Altitude (English Translation).*
International Search Report in related Application No. PCT/IB03/05081.

*Primary Examiner*—Glenn K. Dawson
*Assistant Examiner*—Darwin P Erezo
(74) *Attorney, Agent, or Firm*—Dean W. Russell; Kilpatrick Stockton LLP

(57) ABSTRACT

In order to protect the passengers of an airplane against the effects of depressurization of the cabin, breathing masks are fed with oxygen at a rate which is an increasing function of cabin altitude. Oxygen is fed via a constriction and an economizer bag, and an initial fraction only of the gases breathed out is caused to be re-breathed by collecting the initial fraction in a flexible re-breathing bag in communication with the mask. The re-breathing bag has a volume in inflated state which is not less than the total dead volume of the respiratory tract and the mask. A protective apparatus comprises a feed control unit supplying an adjustable flow rate to masks connected to a general pipe via respective economizer bags. A re-breathing bag retards re-breathing and stores only an initial fraction of the gases breathed out on each exhalation.

15 Claims, 2 Drawing Sheets

FOREIGN PATENT DOCUMENTS

| | | | |
|---|---|---|---|
| DE | 40 19 926 | | 4/1991 |
| EP | 0 905 016 | | 3/1999 |
| FR | 1190440 | | 10/1959 |
| FR | 2557463 | | 7/1985 |
| FR | 2614207 | A2 * | 4/1987 |
| FR | 2696350 | | 4/1994 |
| GB | 836221 | | 6/1960 |
| GB | 934973 | | 8/1963 |

* cited by examiner

FIG.1.
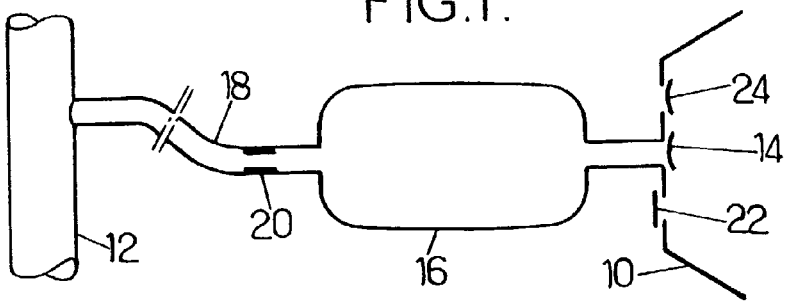
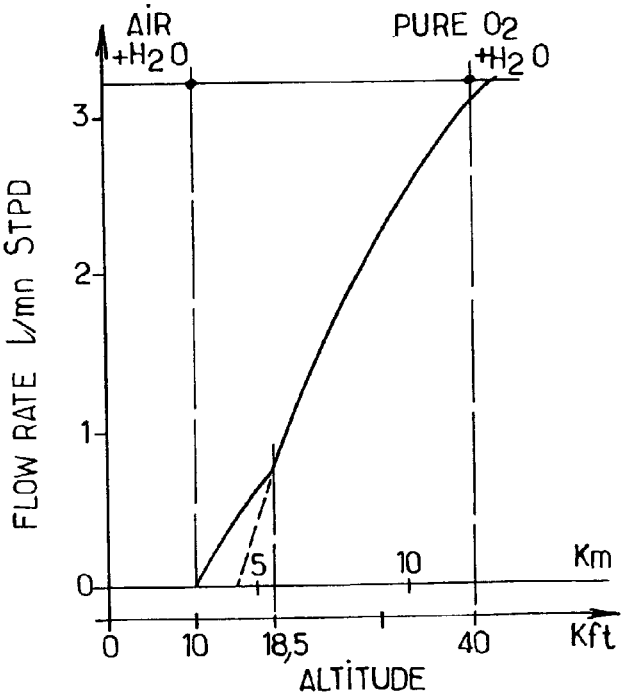
FIG.2.
FIG.3.
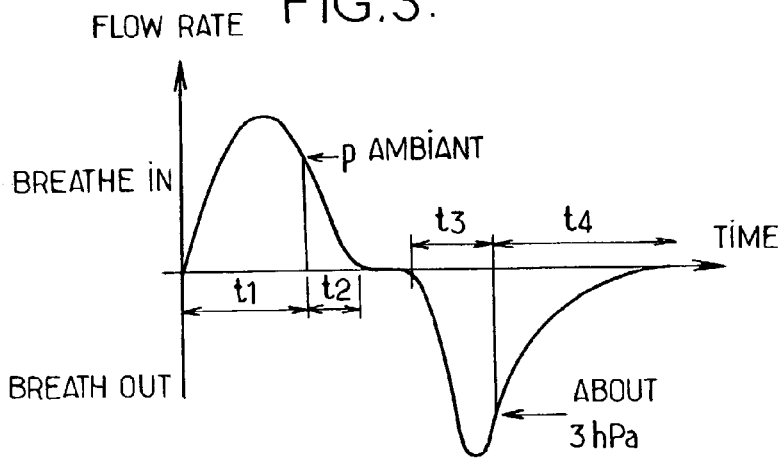

METHOD AND APPARATUS FOR PROTECTING THE PASSENGERS OF AN AIRPLANE AGAINST HYPOXIA

CROSS-REFERENCE TO RELATED APPLICATIONS

This application claims priority to French Patent Application No. 01 15371 filed in the French Patent Office on Nov. 28, 2001, the entire contents of which are incorporated by reference herein.

BACKGROUND OF THE INVENTION

The invention relates to systems for protecting the passengers of an airplane against the effects of cabin depressurization at high altitude by providing them with the oxygen they need to survive.

In most present systems, the principle used is as shown in FIG. 1. The airplane carries a source of oxygen (an oxygen cylinder, a chemical generator known as a "candle", or an on-board generator for generating air that is pressurized and highly enriched in oxygen). The source feeds one or more general distribution pipes. Each seat for a passenger is provided with at least one mouth-and-nose mask 10 connected to the general pipe 12 via a feed path that includes a breathe-in non-return check valve 14, a flexible economizer bag 16, a coupling tube 18 having a constriction 20 for limiting flow rate, and a cock (not shown) which opens when the passenger pulls the mask in order to press it against the face. The mask also has a breathe-out valve 22 and an additional breathe-in valve 24 that is rated so as to present a small amount of resistance. If the rate at which oxygen is admitted from the bag is less than the instantaneous breathe-in demand from the wearer of the mask, valve 24 makes it possible to inhale an additional quantity of air from the outside.

The flexible economizer bag enables the contant flow coming from the source to adapt to the breathing cycle of the wearer: the economizer bag 16 stores the oxygen supplied during the breathe-out stage of the cycle. Its inflated volume generally lies in the range 500 milliliters (ml) to 1000 ml. The amount of oxygen stored in this way is available during the following inhalation and is additional to the quantity of oxygen that continues to be supplied through the constriction 20.

The continuous flow rate supplied by the oxygen source is conventionally expressed in terms of volume per minute, where volume is reduced to normal temperature and pressure conditions when dry (NTPD).

Current Federal Aviation Regulation (FAR) 25 1443 C makes it necessary for the control unit which sets the flow rate delivered to the mask by adjusting the pressure upstream from the constrictions feeding the masks to operate in such a manner that the total NTPD flow rate of oxygen supplied to each passenger varies:

- from 3.8 liters per minute (l/min) to 0.75 l/min when altitude varies from 40,000 feet (ft) to 18,500 ft (i.e. approximately 12,200 meters (m) to 5600 m); and
- from 0.75 l/min to 0 when altitude varies from 18,500 ft to 10,000 ft (5600 m to 3050 m).

That type of operation leads to a relationship between flow rate and altitude presenting a discontinuity at 18,500 ft. This discontinuity can be seen in FIG. 2 which shows a typical variation curve, plotting minima as a function of flight altitude.

In a conventional device using an economizer bag, only 0.3 l/min to 0.6 l/min NTPD of oxygen is actually consumed by the metabolic requirements of the wearer, depending on whether the wearer is calm or stressed. The major portion of the oxygen supplied is thus dumped to the ambient medium together with the gas breathed out. Of the oxygen that is administered, the fraction that is genuinely needed thus lies in the range about 15% at high altitude to less than 30% at lower altitude.

OBJECTS AND SUMMARY OF THE INVENTION

It is an object of the present invention to provide a method and apparatus for increasing that fraction of the oxygen admitted into the mask which is actually used for breathing, thereby making it possible to allow a corresponding decrease in the rate at which the source needs to deliver oxygen. An ancillary object is to reduce the weight and volume of on-board oxygen sources. If the source is oxygen bottle(s), then a lesser storage of on-board oxygen is required for a given maximum length of time after depressurization at altitudes that require passengers to be supplied with additional oxygen. If the source is an on-board generator of air that is highly enriched in oxygen (usually to more than 90%), then the oxygen flow rate capacity and thus the weight thereof can be reduced. Alternatively, it is possible to allow the airplane to continue to fly longer at altitudes that reduce fuel consumption, but require oxygen to be supplied to passengers.

A system has already been proposed in which each mask is fitted not only with an economizer bag but also with a re-breathing bag (French patent FR 2557463), and in which a control unit reduces the oxygen delivery rate beyond a predetermined altitude, typically 12,000 m. The intended purpose of adding such a flexible re-breathing bag was to cause the wearer to inhale a mixture having a higher content of carbon dioxide gas, thereby increasing ventilation of the lungs, and thus enabling a passenger mask to be used at higher cabin altitudes, exceeding 12,700 m, without requiring oxygen pressurization. The additional bag stores $CO_2$ rich breathed-out gas and returns it to the mask during the following inhalation. The economizer bag remains conventional in its characteristics and its oxygen flow rate is unchanged up to 12,000 m. It has, however, been found that the concentrations of $CO_2$ that are needed for sufficient excitation of the breathing rate give rise to physiological difficulties.

In view of the above object, there is provided a method and apparatus enabling a fraction of the oxygen that is dumped during breathing out to be recovered and re-inhaled when taking the following breath, while avoiding any excessive increase in the carbon dioxide content of the inhaled gas, i.e. while limiting hypercapnia to a level that does not give rise to physiological difficulties even after a long duration. It has been found that in order to protect passengers against rapid depressurization due to major malfunction of the system for conditioning cabin atmosphere, breathing hypercapnia should not exceed 2 kilopascals (kPa) on average over the entire volume of gas involved in gaseous exchange with the alveoli (alveolar volume). The term "alveolar volume" is used to designate that fraction of the gas breathed in that actually reaches the gas exchange zones in the alveoli, in contrast to the "dead" volume which remains in the airways of the upper respiratory tract and in gas pipes external to the subject and which, does not contribute to gaseous exchange.

Consequently, there is provided a method for protecting passengers of an airplane against the effects of the cabin depressurizing at high altitudes. According to the method, for cabin altitudes above a determined level (e.g. 3000 meters or 10,000 feet), the breathing masks are fed with oxygen at a rate which increases in proportion of cabin altitude via a flow rate-limiting element such as a constriction and an economizer bag, and an initial fraction only of the breathe-out gas is caused to be re-inhaled by collecting said initial fraction in a flexible re-breathing bag in communication with the mask, said re-breathing bag having a volume in inflated condition that is no greater than the total dead volume of the respiratory tract and the mask for a typical passenger. The oxygen content of the re-breathed gas then remains well above that of the atmosphere.

It is then possible to set the oxygen flow rate delivered by the source at a value lower than the values that are presently usual, as mentioned above; for example reduction can be achieved by modifying the feed pressure supplied by the source and/or the cross-sectional flow areas of the constriction which constitute sonic throat imparting a value to the flow passing therethrough which depends only on the flow cross-sectional area and the upstream pressure.

For optimum use, re-breathing from the bag can be delayed until at least a major fraction of the oxygen contained in the economizer bag has been absorbed, for example by retarding opening of communication between the re-breathing bag and the mask while breathing in. This result can be obtained by placing a rated check valve between the bag and the mask, the check valve being rated to open only when the suction established by breathing-in exceeds a threshold which is reached only after the economizer bag has been almost emptied, but which is still not sufficient to cause ambient air to be sucked in.

The altitude of 3000 meters is based on FAR regulations at the date of the present application, but it may be varied to comply with changes in the regulations.

When the invention is implemented in a system supplying highly enriched air rather than pure oxygen, the capacity of the economizer bag and the optimum volume for the re-breathing bag should be reduced, and the flow rate feeding the mask should be increased accordingly.

The invention can also be implemented in an airplane where the oxygen required for one or more passengers is supplied by a "candle" type chemical generator which supplies oxygen at a flow rate that varies over time, starting from when the candle is started, according to a relationship that is fixed and not modifiable. Under such circumstances, the breathing masks are again fed with oxygen from the chemical generator via an economizer bag, and an initial fraction only of the gases breathed out are caused to be re-breathed by collecting said initial fraction in a flexible re-breathing bag in communication with the mask, said re-breathing bag having a volume in the inflated state that is not less than the total dead volume of the respiratory tract and the mask. The chemical generator is designed to deliver a flow rate which decreases as a function of time, starting from the instant at which it is put into operation, said decrease being in compliance with a determined relationship that is a function of a set profile for descent of the airplane from its nominal cruising altitude and constitutes a fraction only of the flow rate that would be required in the absence of the re-breathing bag. The relationship determining how flow rate varies may itself be pre set by selecting an appropriate shape of candle, for example.

There is also provided an apparatus for protecting the passengers of an airplane against the effects of cabin depressurization at high altitude, the apparatus comprising:

- a feed unit that, in operation, supplies an adjustable continuous flow to a general pipe from a source of 100% oxygen or of highly enriched air under pressure;
- a plurality of passenger breathing masks (devoid of demand regulators) connected to the general pipe, typically via respective constrictions which can have different sizes and via respective economizer bags; and
- a flexible re-breathing bag connected to each of said masks via means for substantially free flow of gas from the mask and for delaying re-breathing during inhalation, the volume of the re-breathing bag being such that it stores only an initial fraction of the gas breathed out on each exhalation;

said feed unit including flow rate regulating means (typically operating by pressure control) in the pipe arranged for adjusting the flow rate responsive to ambient pressure to which the passengers are subjected and limiting the rate of flow at which oxygen is delivered to the masks to a fraction only of a rate that would be required in the absence of re-breathing; that rate may however be increased so as to allow substantially pure oxygen to be breathed at and above a determined altitude.

The term "substantially pure oxygen" is used to mean gas whose oxygen content is that as supplied by the source. In order to comply with FAR regulations, a non-diluted flow rate of oxygen (ignoring dilution by water vapor) corresponding to the total requirements of the passengers must be supplied above 40,000 feet, i.e. 12,200 meters.

The above features and others will appear more clearly on reading the following description of particular embodiments of the invention, given as non-limiting examples. The description refers to the accompanying drawings:

BRIEF DESCRIPTION OF THE DRAWINGS

FIG. 1, mentioned above, is a diagram showing breathing masks for passengers as used at present in civil transport airplanes;

FIG. 2 is a graph plotting a curve representing the additional oxygen flow rate to be supplied to passengers as a function of altitude in compliance with the FAR standards;

FIG. 3 is a diagram showing how the volume breathed in or breathed out during a typical breathing cycle varies as a function of time.

DETAILED DESCRIPTION

Figure 4:
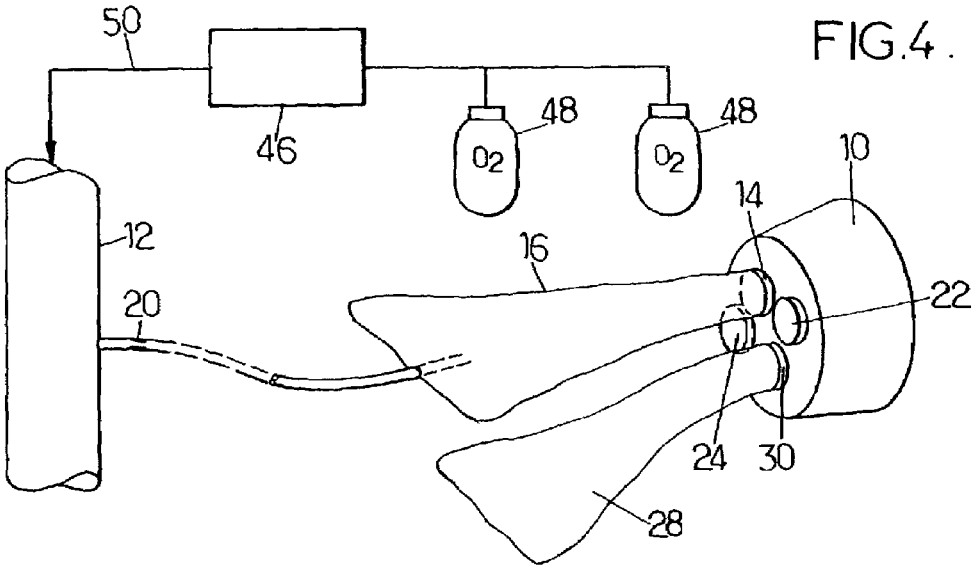
FIGS. 4 to 8 show particular embodiments of the invention.

To achieve the desired result, the invention makes use of the result of the inventors analysis of the breathing cycle which shows that the gases breathed out present a varying partial pressure of carbon dioxide. To show up the essential elements more clearly, there follows a brief summary of the physiology of breathing and an analysis of the consequences thereof.

The respiratory tract of the human being comprises pulmonary alveoli, alveolar ducts, bronchi, the trachea, and the airways of the upper respiratory tract. Only the alveoli and the terminal portions of the alveolar ducts contribute to gas exchange. The fraction of the volume breathed in which remains in the other portions of the respiratory tract at the end of breathing in remains in those other portions of the respiratory tract and is merely expelled to the outside without any change to its composition at the beginning of the following expiration. All of this portion which does not contribute to gas exchange is referred to as "dead volume" $V_D$. The alveolar volume is written $V_A$ and represents the volume of gas which contributes to such exchange. The total volume breathed in is $V_T=V_D+V_A$.

To an approximation that is sufficient for explaining the mechanisms implemented by the invention, it can be assumed that an expiration comprises in succession: expelling the "dead volume" that is free from $CO_2$; a transitory stage; and then a stage in which the alveolar volume is breathed out. The concentration of $CO_2$ plotted as a function of the volume expelled during breathing out can be seen as having a final portion constituted by a straight line of small positive slope and referred to as the "pseudo-alveolar plateau". For an adult subject at rest, the volume breathed out per minute lies in the range 6 liters (l) to 8 l, and breathing takes place at a frequency of about 12 cycles per minute, so the total volume of each breath $V_T$ lies in the range 0.5 cubic decimeters ($dm^3$) to 0.7 $dm^3$, with the "dead volume" $V_D$ lying in the range about 0.15 $dm^3$ to 0.18 $dm^3$ when the subject is wearing a mouth-and-nose mask. The beginning of the pseudo-alveolar plateau corresponds to a partial pressure of $CO_2$ of about 5 kPa and it ends at about 6 kPa.

The invention makes use of the existence of the volume $V_D$ to make it possible to re-breathe that fraction of the volume which is breathed out that is not enriched in $CO_2$ or that is enriched with little $CO_2$. When it is desired not to exceed a partial pressure of 2 kPa in the gases admitted into the pulmonary alveoli, hypercapnia remains light. All that happens is that breathing takes place at a slightly higher frequency because of the excitation caused by the carbon dioxide. In the absence of hypoxia, this gives $V_E$=10 $dm^3$ to 12 $dm^3$ at a frequency of f=15/min and at $V_T$=0.8 $dm^3$. If a small amount of hypoxia does exist, then $V_T$ is practically unmodified while $V_E$ and f increase slightly.

As already mentioned, the invention makes use of the fact that hypercapnia corresponding to a mean partial pressure of 2 kPa during breathing in is acceptable. In general, it is necessary to take account of the fact that the wearer of the mask might be a child, in which case the values given above are no longer valid, or might be an anxious wearer. Nevertheless, a basic principle of the invention lies in recovering the initial portion of expiration which is free from $CO_2$ or has only little $CO_2$ content.

From studies that have been performed, it is found that the quantity of $CO_2$ expelled during each breathing cycle lies in the range 13 cubic centimeters ($cm^3$) to 21 $cm^3$ for an adult subject at rest. It can be deduced therefrom that the maximum quantity of $CO_2$ that can be re-breathed while complying with a maximum partial pressure of $CO_2$ equal to 2 kPa, is 16 $cm^3$ to 20 $cm^3$.

If the initial 400 $cm^3$ of a breathing cycle are breathed back in during the following breath, then the re-breathed volume of $CO_2$ is about 14 $cm^3$. This volume can be further reduced if measures are taken to avoid readmitting gas coming from the preceding breathing cycle until the last fraction of an intake of breath, i.e. that fraction which remains in the dead volume. Under such circumstances, it is possible to envisage raising the volume that is re-breathed up to 500 $cm^3$ without exceeding the maximum pressure of 2 kPa in the alveolar volume. Under such circumstances, the amount of oxygen that needs to be fed to the wearer of the mask can be reduced to substantially ⅜ths of the quantity that would otherwise be required in the absence of re-breathing.

Other studies have made it possible to determine the conditions that need to be satisfied when the subject is highly anxious or a child. With an anxious subject, the value $V_T$ of the breathing cycle is much less than 400 $cm^3$. This constraint is, however, overcome if means are provided for retarding re-breathing until the content of the economizer bag has been emptied.

In particular, operation can be of the kind illustrated in FIG. 3. During the initial stage of breathing in, for a duration t1, the wearer of the mask breathes in oxygen coming from the economizer bag and fresh oxygen that continues to arrive. The duration t1 comes to an end when the pressure in the mask drops down practically to ambient pressure. From this moment, and for a duration t2, breathing in takes place from the re-breathing bag.

At the beginning of breathing out, gas having a high oxygen content and a low carbon dioxide content is stored in the re-breathing bag over a duration t3. The duration t3 can be adjusted in various ways, for example by a suitable choice for the volume of the re-breathing bag, and also by adjusting the resistance at which the check valve for breathing out to the atmosphere opens. Often adjustment of these parameters will lead to gas transfer to the re-breathing bag being interrupted once the pressure is about 3 hectopascals (hPa) . After the mask has been filled, and for a duration t4, breathing out takes place to the atmosphere.

Various embodiments of the invention are described below as non-limiting examples.

In the example shown in FIG. 4, the economizer bag 16 and the flexible re-breathing bag 28 are separate. The economizer bag 16 opens out into the mask via a check valve 14 that opposes practically no resistance to breathing in. The valve 22 for breathing out to the atmosphere is provided with resilient return means for retarding exhaustion to the atmosphere so as to enable the re-breathing bag 28 to be filled, i.e. to retard exhaust to the atmosphere until the end of duration t3.

The re-breathing bag 28 opens out into the mask 10. In a simple embodiment, it opens out directly. Nevertheless, it is preferable to dispose means between the re-breathing bag 28 and the mask making the following possible:

- storage of the initial fraction of the gas that is breathed out (period t3) which implies not opposing any resistance to filling; and
- retarding the transfer to the mask of gas stored in the re-breathing bag until the final period during breathing in (period t2).

Figure 5:
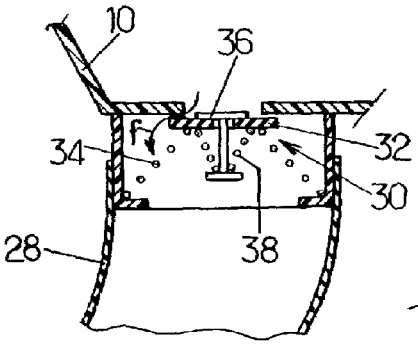

For this purpose, the means providing communication between the bag 28 and the mask may be constituted by a pair of valves 30 of the kind shown in FIG. 5. They comprise a breathe-out check valve 32 provided with a return spring 34 that exerts a force that is very weak, being just sufficient to keep the breathe-out valve closed when at rest. Thus, breathing out into the bag 28 takes place from the beginning of expiration and follows the path shown by arrow f. A check valve 36 for breathing-in from the bag is, in contrast, urged towards its closed position by a spring 38 that retards breathing in until an under pressure appears in the mask.

Such a structure attenuates the problem of the mask being used by children; because of their small total volume $V_T$, children will breathe in essentially only oxygen coming from the economizer bag.

Figure 6:
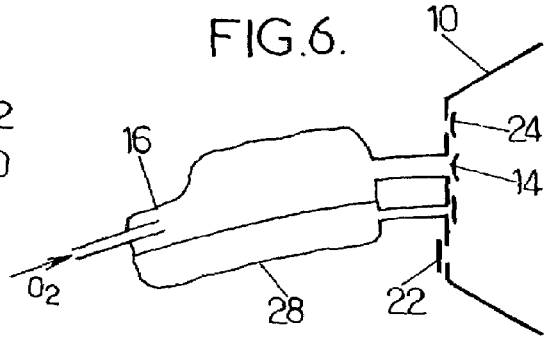

In the modified embodiment shown diagrammatically in FIG. 6, the two bags are connected together, which amongst other advantages presents the advantage of making storage easier.

Figure 7:
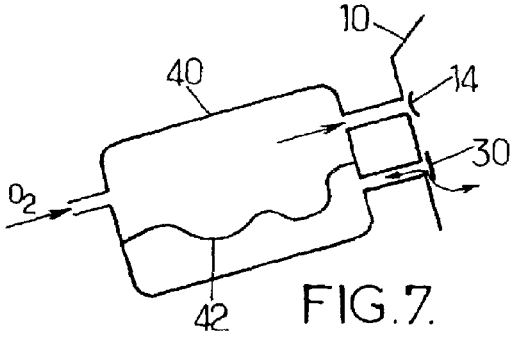

In the example shown in FIG. 7, the two bags are defined in a common inextensible outer enclosure 40 having a flexible separator diaphragm 42. The enclosure 40 may be rigid, however, for storage purposes, it will normally be flexible. In the example of FIG. 7, the re-breathing bag can fill only if the economizer bag has been emptied during the preceding portion of inhalation. This disposition, whether used on its own or in association with means of a kind shown in FIG. 5 provides inherent adaptation to operating with small volumes being breathed, in particular when protecting children.

A disposition that is functionally equivalent to that of FIG. 7 consists of placing the economizer bag inside the re-breathing bag, in which case the outside wall thereof constitutes the equivalent of the enclosure 40. Another disposition consists in placing the re-breathing bag inside the economizer bag.

Figure 8:
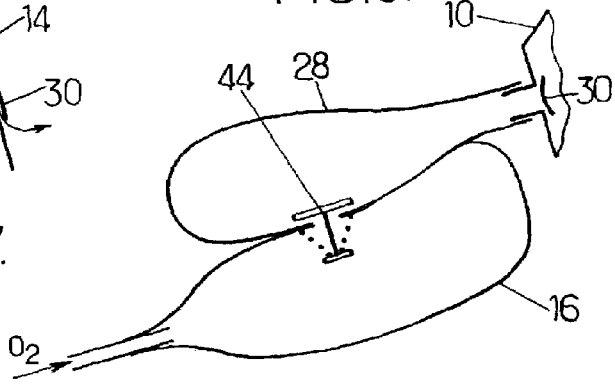

Finally, yet another example consists in uniting the bags 16 and 28 both functionally and structurally as shown diagrammatically in FIG. 8. This solution is nevertheless not so advantageous as the preceding solutions in terms of re-breathing gas containing $CO_2$. In this case it is initially the content of the re-breathing bag that is breathed in. However this drawback exists only when the volume being breathed is the nominal volume, since the re-breathing bag cannot empty unless the economizer bag has itself been emptied. FIG. 8 is a diagram of one such embodiment. A check valve 44 is interposed between the economizer bag 16 and the re-breathing bag 28.

Additional studies have enabled values to be determined that are close to optimum in terms of oxygen consumption, while nevertheless taking account of the need to avoid exceeding a $CO_2$ partial pressure of about 2 hPa.

The table below shows the oxygen consumption required for different volumes of re-breathing bag (where the value 0 corresponds to no bag).

| Additional oxygen | Bag volume ($cm^3$) rate | | | | |
|---|---|---|---|---|---|
| flow (1/min) NTPD | 0 | 400 | 500 | 600 | 750 |
| 40,000 feet (12,200 m) | 3.000 | 1.932 | 1.656 | 1.380 | 0.966 |
| 35,000 feet (11,500 m) | 2.658 | 1.691 | 1.450 | 1.208 | 0.846 |
| 30,000 feet (9,140 m) | 2.195 | 1.396 | 1.197 | 0.997 | 0.698 |
| 20,000 feet (6,090 m) | 0.970 | 0.617 | 0.529 | 0.441 | 0.309 |
| 18,500 feet (5,635 m) | 0.744 | 0.473 | 0.406 | 0.338 | 0.237 |

It will be appreciated that with a 500 $cm^3$ re-breathing bag it is possible to reduce the oxygen flow rate required to half its present value at most altitudes. By increasing the volume of the bag, it is possible to further reduce the rate at which oxygen is required. A volume of 600 $cm^3$ remains acceptable. Above that, there is a risk of instability when small quantities are breathed on each cycle, in particular by children. In addition, a value of 750 $cm^3$ would also fail to comply with standards at altitudes below about 5600 m.

In practice, the volume of the re-breathing bag in the full state should lie in the range from about 400 $cm^3$ to 600 $cm^3$. The volume of the economizer bag should be reduced correspondingly. In general, an economizer bag and a re-breathing bag should be chosen so that the sum of their volumes, in the inflated state, is approximately twice the volume of a present-day economizer bag, i.e. 1000 $cm^3$ to 1600 $cm^3$.

In general, a passenger transport airplane is fitted with an installation having a source of oxygen 48 (oxygen cylinder or on-board generators), or with a plurality of such installations each allocated to a fraction of the cabin. A distribution control unit 46 feeds pipes 50 for feeding the masks (FIG. 4). The control unit 46 is generally designed to feed the pipes 50 at a pressure that varies as a function of altitude, either in by steps or else progressively. Flow rate is controlled indirectly by monitoring the pressure of oxygen admitted into the pipes 50. Flow rate is advantageously controlled so as to deliver a flow of additional oxygen that is not less than the flow actually required, as defined in the table above.

The way in which steps are spread out in the event of depressurization must comply with regulations. At the beginning of depressurization, the control unit 46 acts automatically in response to depressurization being detected by sensors, or if necessary in response to manual control, in order to feed the pipes. If the airplane altitude makes it impossible to feed the passengers with a sufficient flow of additional oxygen throughout the time needed to reach an alternative airport, then the crew reduces altitude progressively down to a value which is compatible both with passenger safety and with fuel consumption. The airplane will often be brought down to an altitude of no more than 35,000 feet or 11,500 meters, which reduces the consumption of additional oxygen by 15% compared with flying at an altitude of about 40,000 feet, with an appropriate rate of height loss being applied to the airplane.

In certain airplanes, used on routes where the maximum duration spent at altitude requiring oxygen to be supplied during a diversion to an alternative airport does not exceed about 30 minutes, then the oxygen source can be constituted by one or more chemical generators each feeding one or more masks. Under such circumstances, it is not possible to control at will the flow rate at which oxygen is supplied. Once the generator has been started, it supplies at a rate that varies over time in a manner that is fixed on manufacture. This variation is designed to decrease at a determined rate as a function of the descent profile of the airplane from its nominal cruising altitude to the altitude at which it is maintained while being diverted. When the invention is implemented, the chemical generators can be designed in such a manner that the rate at which they deliver the oxygen varies over time takes account of the savings in the volume of additional oxygen resulting from re-breathing. It follows that oxygen-supply capacity of the on-board chemical generators can be considerably smaller than that required in the absence of re-breathing.

The invention claimed is:

1. A method of protecting passengers of an airplane against depressurization of a passenger cabin of the airplane at high altitude, comprising, at least at cabin altitudes higher than a predetermined altitude:

feeding a breathing mask for a passenger of said airplane with oxygen at a flow rate which is an increasing function of cabin altitude via a flow-rate limiting constriction and an economizer bag, and collecting an initial fraction of gases breathed out by the passenger in a flexible re-breathing bag in communication with the mask said initial fraction corresponding to the substantially $CO_2$-free dead volume of the passenger's respiratory tract; and effecting breathing by the passenger of said oxygen via the economizer bag while inhibiting breathing from the re-breathing bag and, when at least a major part of said oxygen contained in the economizer bag is breathed in, effecting re-breathing by the passenger of at least a portion of said initial fraction from the re-breathing bag.

2. A method according to claim 1 wherein the predetermined altitude is 4570 meters.

3. A method according to claim 1 in which the action of effecting breathing and re-breathing comprises delaying opening of a communication between the re-breathing bag and the mask after beginning of inhalation by the passenger wearing said mask.

4. Apparatus for protecting passengers of an airplane against depressurization of a passenger airplane cabin at high altitude, comprising:

a feed control unit for supplying an adjustable continuous flow rate to a general pipe from a source of pure oxygen or of highly oxygen enriched air under pressure;

a plurality of breathing masks devoid of demand regulators each for a passenger, connected to said general pipe via a flexible economizer bag; and a flexible re-breathing bag connected to each of said masks by means enabling gas to enter freely into said flexible re-breathing bag from the mask, the re-breathing bag having a volume when inflated such that it is capable of storing an initial fraction of the gas breathed out on each exhalation by the passenger wearing the mask, said initial fraction corresponding to the substantially $CO_2$-free dead volume of the passenger's respiratory tract, means for (i) effecting breathing by the passenger of said oxygen via the economizer bag while inhibiting breathing from the re-breathing bag and, when at least a major part of said oxygen contained in the economizer bag is breathed in, (ii) effecting re-breathing by the passenger of at least a portion of said initial fraction from the re-breathing bag, said control unit having means for regulating the flow rate of additional oxygen delivered to said pipe responsive to ambient pressure to which the mask wearers are subjected in order to limit said flow rate to a fraction only of the flow rate would be necessary in the absence of re-breathing.

5. Apparatus according to claim 4, wherein said control unit has flow regulator means operating by controlling oxygen pressure in the pipe, each mask being connected to the pipe via a respective constriction.

6. Apparatus according to claim 4, wherein the re-breathing bag has a volume of from 400 to 600 ml when inflated.

7. Apparatus according to claim 6, wherein the re-breathing bag and the economizer bag carried by one of said masks have a total volume of from 1000 ml to 1600 ml when inflated.

8. Apparatus according to claim 4, further comprising a check valve between the economizer bag and the mask and a breathe-out valve opening to a surrounding atmosphere is provided with resilient return means that retard exhausting from the mask to the atmosphere.

9. Apparatus according to claim 4, wherein the economizer bag and the flexible re-breathing bag are separate and are independently connected to the mask.

10. Apparatus according to claim 4, wherein the means for effecting breathing and re-breathing comprise valve means having a breathe-out non return check valve and a breathe-in valve for breathing in from the re-breathing bag that is urged into a closed condition by a spring that retards breathing-in until a predetermined level of suction has appeared in the mask.

11. Apparatus according to claim 4, wherein the two bags are defined within a common inextensible outer enclosure by a flexible separating diaphragm.

12. An apparatus according to claim 4 in which the means for effecting breathing and re-breathing comprises a normally-closed valve interposed between the re-breathing bag and the breathing mask, the valve comprising a spring whose closing force is overcome when the mask is under pressure sufficient to signify that said major part of said oxygen contained in the economizer bag has been breathed in by the passenger.

13. A method of protecting the passengers of an airplane against depressurization of the cabin at high altitude, comprising the steps of:

continuously feeding a passenger breathing mask for a passenger of said airplane with oxygen from a chemical generator via an economizer bag, collecting an initial fraction of breathed out gases from the passenger in a flexible re-breathing bag in communication with the mask, said initial fraction corresponding to the substantially $CO_2$-free dead volume of the passenger's respiratory tract, said chemical generator being arranged for supplying oxygen at a flow rate that decreases, from the instant at which the generator is put into service, as a decreasing function of time in compliance with a predetermined relationship which is a function of a nominal descent profile of the airplane from a nominal cruising altitude of the airplane and which is a fraction only of the flow rate that would be necessary in the absence of the re-breathing bag; and effecting breathing by the passenger of said oxygen via the economizer bag while inhibiting breathing from the re-breathing bag and, when at least a major part of said oxygen contained in the economizer bag is breathed in, effecting re-breathing by the passenger of at least a portion of said initial fraction from the re-breathing bag.

14. A method of protecting a passenger of an aircraft against depressurization of the aircraft at high altitude, the method comprising, at least at cabin altitudes higher than a predetermined altitude:

a. providing a passenger oxygen-supply assembly comprising a breathing mask and re-breathing and economizer bags in gaseous communication with the breathing mask b. while inhibiting breathing from the re-breathing bag, permitting a passenger wearing the breathing mask to breathe in at least a major part of the oxygen contained in the economizer bag and to breathe out, into the re-breathing bag, an initial fraction of gases corresponding to the substantially $CO_2$-free dead volume of the passenger's respiratory tract; and c. when said major part of said oxygen contained in the economizer bag has been breathed in by the passenger, effecting re-breathing by the passenger of at least a portion of said initial fraction from the re-breathing bag.

15. A method according to claim 14 further comprising providing a normally-closed valve between the re-breathing bag and the breathing mask, the valve comprising a spring whose closing force is overcome when the mask is under pressure sufficient to signify that said major part of said oxygen contained in the economizer bag has been breathed in by the passenger.

* * * * *